United States Patent [19]

Dennis

[11] 4,426,677

[45] Jan. 17, 1984

[54] COMBINED SHADE AND SOCKET HOLDER

[75] Inventor: Warren E. Dennis, Pasadena, Calif.

[73] Assignees: Casablanca Fan Company, Inc., City of Industry, Calif.

[21] Appl. No.: 351,274

[22] Filed: Feb. 22, 1982

[51] Int. Cl.[3] ..... F21V 17/06

[52] U.S. Cl. ..... 362/438; 362/294; 362/373; 362/408; 362/439; 362/443; 362/453; 362/454; 362/455; 362/456

[58] Field of Search ..... 362/437, 438, 408, 439, 362/443, 448, 453, 454, 455, 456, 373, 294

[56] References Cited

U.S. PATENT DOCUMENTS

| | | | |
|---|---|---|---|
| 2,026,756 | 1/1936 | Surface | 362/408 |
| 2,070,877 | 2/1937 | Arras | 362/448 |
| 2,319,621 | 5/1943 | McLaughlin | 362/439 |
| 2,435,679 | 2/1948 | Goebel | 362/448 |

*Primary Examiner*—Stephen J. Lechert, Jr.
*Attorney, Agent, or Firm*—Charles H. Schwartz; Ellsworth R. Roston

[57] ABSTRACT

A combined shade and socket holder for being mounted at the end portion of a tubular member and for use in supporting an electrical socket having an opening through a back wall of the socket and for use in supporting a shade, including, a generally cup-shaped housing formed with a closed end portion, an open end portion and an intermediate connecting central portion, the closed end portion including an outwardly extending tubular portion having an unthreaded interior surface for receiving the end portion of the tubular member and a stop surface within the tubular portion for limiting the extension of the end portion of the tubular member within the tubular portion, the closed end portion additionally including light locking members adjacent the tubular portion for locking the end portion of the tubular member within the tubular portion, the central portion for receiving the electrical socket to have the back wall of the electrical socket positioned adjacent the interior surface of the closed end portion and with the closed end portion including an opening complementary in position to the opening through the back wall of the socket, a second locking member coupled to the complementary openings in the electrical socket and the closed end portion for locking the electrical socket in the received position within the central portion, and the open end portion extending outwardly relative to the closed end portion for receiving an end portion of the shade and additionally including third locking members for locking the shade in the received position.

10 Claims, 5 Drawing Figures

COMBINED SHADE AND SOCKET HOLDER

BACKGROUND OF THE INVENTION

1. Field of the Invention

The present invention is directed to a combined shade and socket holder. Specifically the combined shade and socket holder of the present invention may be used with a ceiling fan but may also be used as part of a ceiling or wall fixture.

2. Description of the Prior Art

In general, the prior art shade and socket holders have been of two types and with both types receiving and supporting an electrical socket and also receiving and supporting a shade surrounding the electric bulb. The oldest type of fixture generally includes a two piece metal outer casing for receiving an electrical socket and with an insulating member such as a cardboard tube intermediate the socket and the outer casing. The outer casing generally includes a tubular member and an end cap and with a snap fit arrangement between the end cap and the outer casing. An additional insulating member is also disposed in the end cap so as to prevent shorting between the electrical wires and the outer casing. At the end of the outer casing opposite the cap, a separate ring member is supported to extend outwardly to receive an end portion of the shade.

Electrical wires for energizing the socket are normally disposed within a tube member and the tube member in general has a threaded end. The end cap includes a threaded opening and the threaded end of the tube member is received within the threaded opening in the end cap. In this way the prior art fixture is supported at the end of the tube member.

In general, this first type of prior art shade and socket holder is cumbersome in appearance since it is composed of a plurality of parts. In addition, the various parts must be properly assembled which increases the cost of assembly. In order to alleviate some of the problems inherent in the first type of prior art fixture, a new type of electrical socket has been more recently introduced and used in electrical fixtures.

The new type of electrical socket is formed with a plastic outer casing receiving the inner metal member and includes a threaded outwardly extending flange. This new type of socket does not include an outer metal two piece casing but, in order for this new type of electrical socket to be used as part of a fixture to both receive a light bulb and at the same time support a shade, a further outer casing must still be used. This outer casing is generally formed as a large cap member to surround the socket and includes means for supporting the shade. In addition, the threaded outwardly extending flange is located within the large cap member and with the cap member including an opening to pass the threaded end of the tube member. The threaded end is then received within the threaded flange so as to support the socket at the end of the tube member which guides the electrical wires. Since the end of the tube member passes through the opening through the outer cap member, this captures the outer cap member in position. Although this second type of structure is somewhat simpler in assembly, since the socket is formed as a one piece member, it is still necessary to thread the end of the tube member through the outer cap and into the outwardly extending flange of the socket while maintain the plurality of parts in the proper relationship during this assembly.

SUMMARY OF THE INVENTION

Applicant's invention provides for a combined shade and socket holder which is simplier in construction and assembly than the prior art structures. In particular, applicant's combined shade and socket holder includes a one piece outer housing which receives and locks the socket in position without the need of any threaded outwardly extending flange and receives and is locked on the end portion of the tube member without the need for any threaded engagement between these parts. In particular, the combined shade and socket holder of the present invention uses the new type of plastic socket but with the outwardly extending flange member eliminated. In addition, a recessed portion of the socket which had been previously used to receive a foot section of the flange member, may now be used to provide for a locating guide. By having this recessed portion match a raised portion of the outer housing, an interlocking structure is provided to locate the socket within the outer housing.

At an outside position of the outer housing, an elongated unthreaded tubular portion, having an inner stop surface, is designed to receive an end portion of the tubular member which guides the electrical wires. The end portion of the tubular member does not have to include any threads since the end of the tubular member is locked in position by a locking screw which bears against the end portion of the tubular member as it is positioned within the outer tubular portion of the outer housing forming the combined shade and socket holder of the present invention.

The structure of the present invention, therefore, provides for a relatively simple housing to receive and support and properly locate a socket member in position and with the housing receiving and being supported on the end of the tubular member. An open end portion of the structure may extend outwardly at the end opposite the tubular portion and with this extending open end portion designed to receive and support a shade. The assembly of the combined shade and socket holder of the present invention is considerably simpler than prior art devices and, in addition, the structure of the present invention has a cleaner appearance and provides for a more stable support of both the socket and the outer shade. This results from the unitary structure of the housing and with the other parts properly interlocked in a stable relationship.

BRIEF DESCRIPTION OF THE DRAWINGS

A clearer understanding of the present invention will be had with reference to the following description and drawings wherein.

DESCRIPTION OF THE PREFERRED EMBODIMENT

Figure 1:
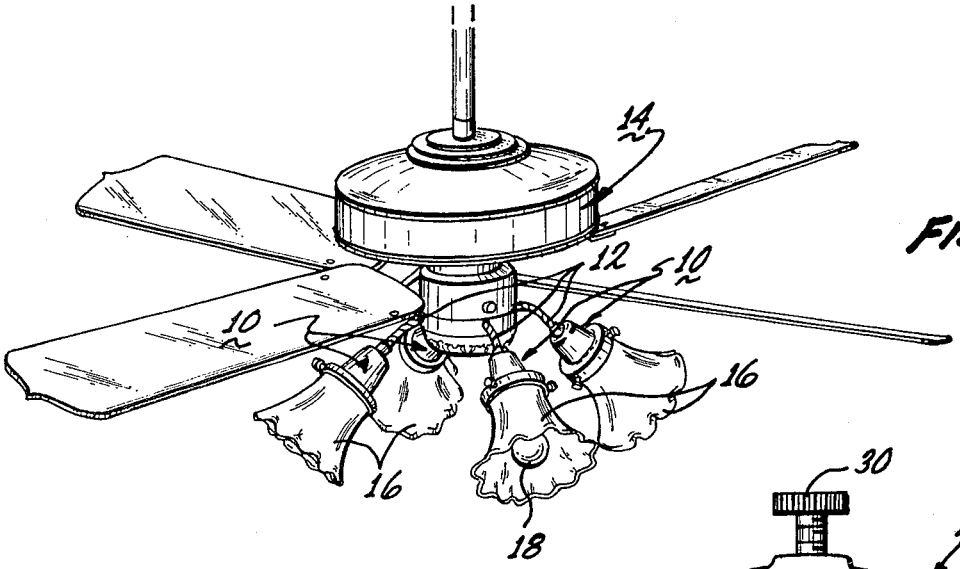
FIG. 1 illustrates a perspective view of a plurality of the combined shade and socket holders of the present invention supported at a bottom position on an electrical fan.
Figure 2:
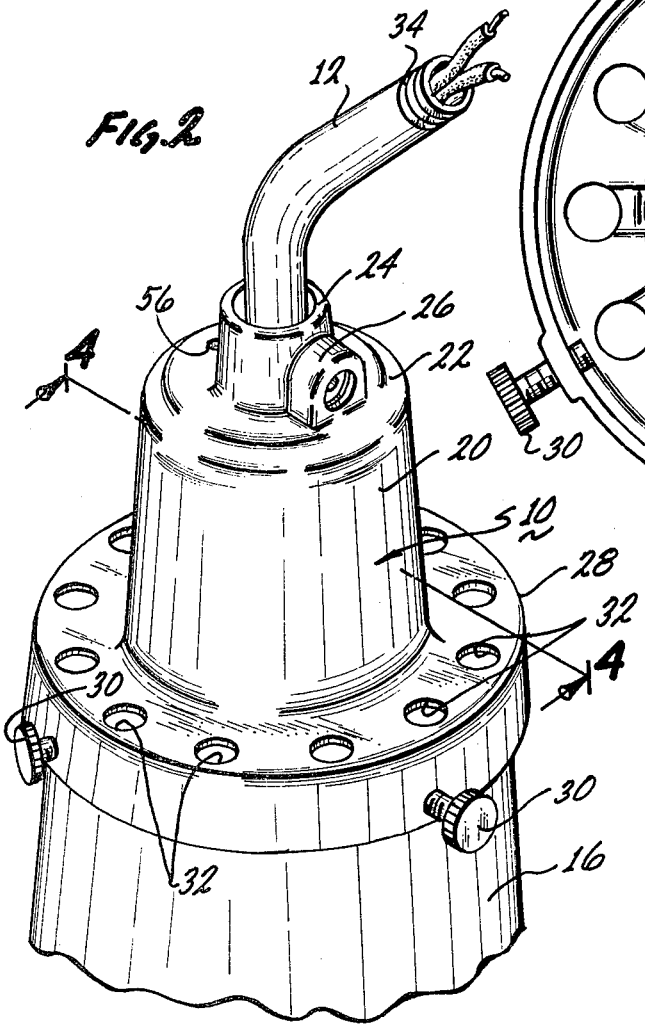
FIG. 2 is a perspective view of a single combined shade and socket holder of the present invention.
Figure 5:
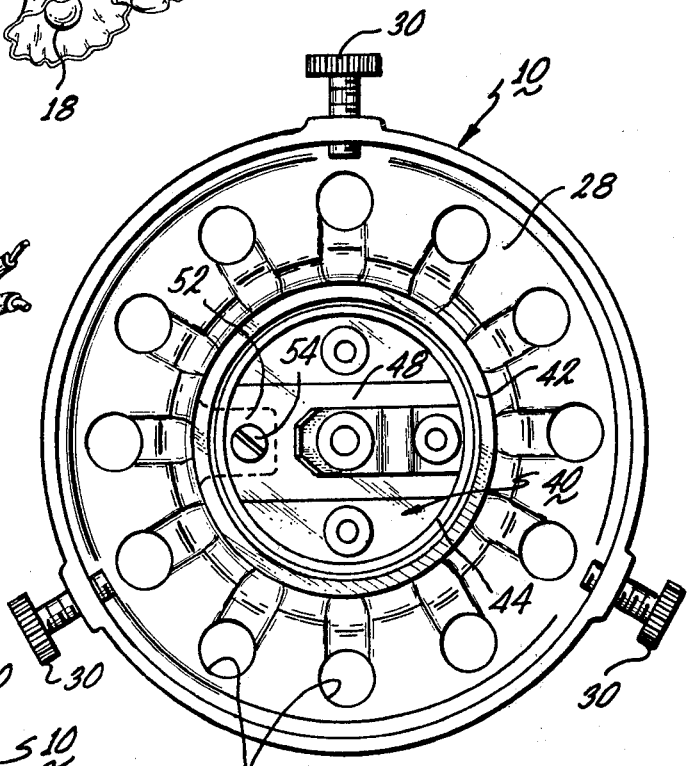
FIG. 5 is a bottom view of the combined shade and socket holder of the present invention.

In FIG. 1, a plurality of combined shade and socket holders 10 of the present invention is shown supported by a plurality of tube members 12 at the bottom portion of a ceiling fan 14. Each combined shade and socket holder 10 receives and supports a glass shade 16 and, additionally, receives and supports a light bulb 18, one of which is shown. It is to be appreciated that, although the combined shade and socket holder 10 of the present invention is shown supported at the bottom of the ceiling fan 14, the holder 10 may also be used as part of a ceiling or wall fixture.

Figure 3:
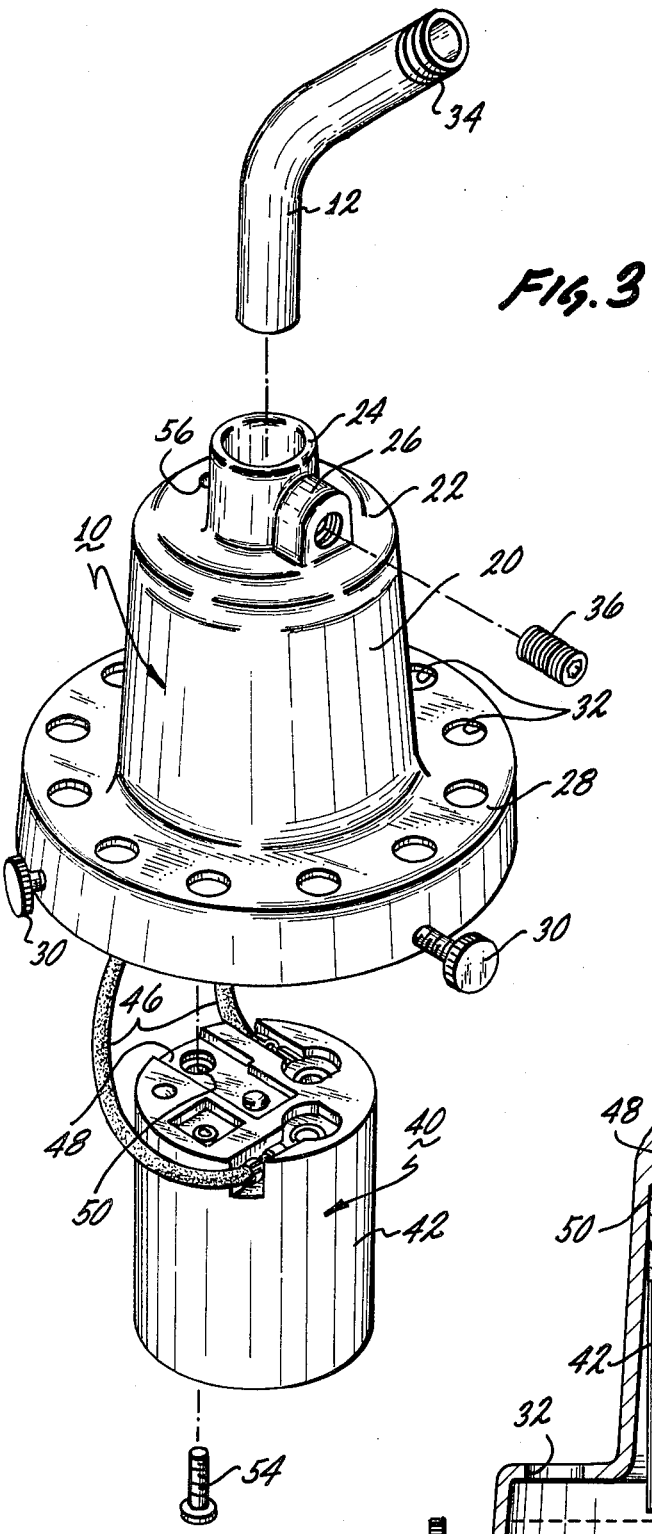
FIG. 3 is an exploded perspective view of the combined shade and socket holder of FIG. 2.
Figure 4:
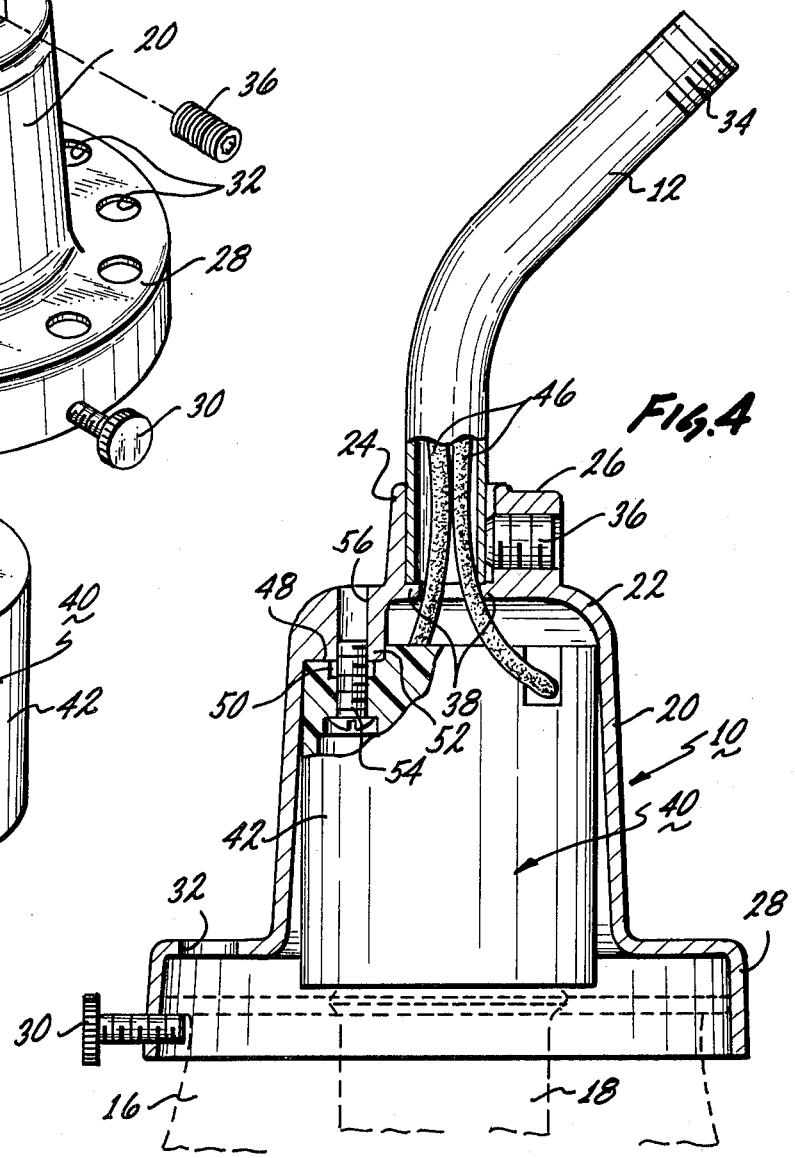
FIG. 4 is a cross-sectional view taken along lines 4—4 of FIG. 2.

FIGS. 2 through 5 illustrate the combined shade and socket holder 10 incorporating the teachings of the present invention. In particular, the combined shade and socket holder 10 of the present invention is formed as a cast housing having a generally cup-shaped configuration and including a central tubular portion 20, a closed end portion 22 and an open end portion 28. The closed end portion 22 has an outwardly extending tubular portion 24 and with an adjacent boss portion 26. The outwardly extending open end portion 28 includes a plurality of spaced screw means 30 for supporting a lip at the inner end of the shade 16 in a known manner as shown in FIG. 4. The open end portion 28 may include ventilating holes 32 for providing an escape for heat generated by the light bulb 18. This can be seen with reference to FIG. 4 where the shade 16 and light bulb are shown in dotted lines.

The combined shade and socket holder 10 is supported at the end of the tubular member 12 and with one end portion of the tubular member 12 received within the extending tubular portion 24. Specifically as shown with reference to FIGS. 2, 3 and 4, the one end portion of the tubular member 12, which is positioned within the extended tubular portion 24, need not be threaded and there are no threads within the extending tubular portion 24. The one end portion of the tubular member 12 is actually locked in position using a screw member 36 which threads through a threaded opening in the boss 26 to lock against the one end of the tubular member 12.

The screw member 36 maintains the tubular member 12 in position to thereby support the combined shade and socket holder at the one end of the tubular member 12. The other end of the tubular member 12 may be threaded as shown at position 34 so as to provide for the proper support for the entire structure such as shown in FIG. 1 at the bottom of a ceiling fan. The use of the boss 26 allows for a number of threads of the screw 36 to be captured to thereby allow for a relatively high force by the screw 36 against the one end of the tubular member 12 without stripping the threads. This structure securely captures the one end of the tubular member 12 within the extending tubular portion 24 without the need of a threaded engagement between the one end and the tubular portion. In addition, an inner wall portion 38 has a diameter smaller than the outer diameter of the one end of the tubular member 12 thereby effectively providing for a stop surface so that the tubular member 12 can only extend a particular distance within the extending tubular portion 24.

The central portion 20 of the combined shade and socket holder is formed as a slightly tapered tubular member so as to receive and support an electrical socket 40. The electrical socket 40 may be of the type having an outer plastic casing 42 receiving and supporting an inner metallic threaded member 44 which receives the standard threaded end of the light bulb 18 and with electrical current supplied to the light bulb in a standard fashion. As shown in FIG. 4, a pair of wires 46 pass through the tube member 12 and through the inner wall portion 38 into the interior of the shade and socket holder 10. The wires are connected to the electrical socket 40 for supplying current to the light bulb 18.

Additionally, as shown in FIG. 3, a back wall, of the socket 40, includes a recessed area 48 and with an opening 50 passing through the recessed area 48 of the socket 40 into the interior of the socket. As shown in FIG. 4, the interior surface of the closed end portion 22 of the shade and socket holder 10 includes a raised portion 52 complementary to the recessed area 48 of the socket 40. The raised portion 52 is also shown in dotted lines in FIG. 5. The complementary raised portion 52 and recessed area 48 form an interlock to locate the socket 40 within the central portion 20 of the combined shade and socket holder 10. A screw member 54 passes through the opening 50 in the back wall of the socket 40 and is received in a threaded opening 56 passing through the raised portion 52 of the closed end portion 22 of the shade and socket holder 10.

In general, the assembly of the shade and socket holder of the present invention is relatively simple when compared with the prior art structures. Specifically, the socket 40 would normally have the pair of wires of 46 attached, either using rivets or screws, and with the wires passed into the interior of the socket holder 10 and through the extended tubular portion 24. The socket 40 is then seated in position using the complementary recessed area 48 and the raised portion 52 and with the screw member 54 threaded into the opening 56 to lock the socket member 40 securely within the central portion 20. The pair of wires 46 are now passed through the tubular member 12 and the one end portion of the tubular member 12 is seated within the extending tubular portion 24. The threaded member 36 is now tightened to lock the one end portion of the tubular member 12 securely within the tubular portion 24. The entire combined shade and socket holder is now completely assembled and may then be attached either to an electrical fixture or to a ceiling fan such as shown in FIG. 1. When this is accomplished, the shade 16 may now be received within the open end portion 28 and with the shade held in position by the spaced screw members 30.

The present invention, therefore, is directed to a combined shade and socket holder having a very simple construction and design and using a one piece cup-shaped housing which is preferably cast and with this outer housing serving to receive an electrical socket member and with the electrical socket member held in an interlocked position by a complementary recessed area and raised portion and held in position by a single locking screw and with the cup-shaped housing mounted at the end of a tubular member and held in position by the use of a single locking screw.

Although the invention has been described with reference to a particular embodiment, it is to be appreciated that various adaptations and modifications may be made and the invention is only to be limited by the appended claims.

I claim:

1. A combined shade and socket holder for support at the end of a tubular member and for use in supporting an electrical socket having an opening through a back wall of the socket and for use in supporting a shade, including, a generally cup-shaped unitary cast housing formed with a generally closed end portion, an open end portion and an intermediate connecting central portion extending between the closed and open end portions for a distance approximating the length of the socket, the closed end portion including a first opening and extending from the first opening an outwardly extending tubular portion having an unthreaded interior surface for receiving an end portion of the tubular member and a stop surface within the tubular portion for limiting the extension of the end portion of the tubular member within the tubular portion of the tubular member within the tubular portions, the closed end portion additionally including means adjacent the tubular portion for locking the end portion of the tubular member within the tubular portion, the central portion for receiving and enclosing the electrical socket to have the back wall of the electrical socket positioned adjacent the interior surface of the closed end portion and with the closed end portion including a second opening complementary in position to the opening through the back wall of the socket, means coupled to the complementary openings in the electrical socket and the closed end portion for locking the electrical socket in the received position within the central portion, and the open end portion extending outwardly relative to the closed end portion for receiving an end portion of the shade and additionally including means for locking the shade in the received position to extend away from the electrical socket.

2. The combined shade and socket holder of claim 1 wherein the first opening has a diameter less than the outside diameter of the tubular member to form the stop surface.

3. The combined shade and socket holder of claim 1 wherein the additional means adjacent the tubular portion includes a portion formed as a boss and with a threaded opening extending through the boss and into the tubular portion and with the threaded opening receiving a threaded member to lock against the end portion of the tubular member within the tubular portion.

4. The combined shade and socket holder of claim 1 wherein the central portion is formed with an interior dimension to closely surround the electrical socket and with the open end portion flaring outwardly from the central portion.

5. The combined shade and socket holder of claim 1 wherein at least one of the complementary openings in the electrical socket and the closed end portion is threaded and wherein the means coupled to the complementary openings is a threaded member threaded into the threaded opening for locking the electrical socket in the receiving position within the central portion.

6. The combined shade and socket holder of claim 5 wherein the threaded opening is in the closed end portion and the threaded member passes through the opening in the back wall of the electrical socket and into the threaded second opening.

7. The combined shade and socket holder of claim 1 wherein the electrical socket includes a recessed area in the back wall and the interior surface of the closed end portion of the housing includes a raised portion complementary to the recessed area for providing interlocking portions to align the complementary openings.

8. The combined shade and socket holder of claim 1 wherein the holder is for use with a shade that has its end portion including a lip and the means for locking the shade includes spaced threaded members for capturing the lip within the open end portion.

9. The combined shade and socket holder of claim 8 wherein the open end portion extends outwardly and then downwardly to provide a recess for receiving the end portion of the shade.

10. The combined shade and socket holder of claim 9 additionally including openings at spaced positions around the open end portion for providing ventilation.

* * * * *